United States Patent [19]

Ackroyd

[11] 4,241,752

[45] Dec. 30, 1980

[54] BACKFLOW PREVENTER

[75] Inventor: Rand H. Ackroyd, Methuen, Mass.

[73] Assignee: Watts Regulator Company, Lawrence, Mass.

[21] Appl. No.: 910,509

[22] Filed: May 30, 1978

[51] Int. Cl.[3] ..... F16K 24/00

[52] U.S. Cl. ..... 137/107; 137/218

[58] Field of Search ..... 137/102, 103, 107, 217, 137/218

[56] References Cited

U.S. PATENT DOCUMENTS

| | | | |
|---|---|---|---|
| 2,503,424 | 4/1950 | Snyder | 137/218 UX |
| 2,620,816 | 12/1952 | Griswold | 137/218 |
| 3,173,439 | 3/1965 | Griswold et al. | 137/107 |
| 3,818,929 | 6/1974 | Braukmann | 137/218 |
| 4,090,527 | 5/1978 | Sutherland | 137/218 X |

*Primary Examiner*—Robert G. Nilson

[57] ABSTRACT

A backflow preventer comprising a body defining a passage for flow of liquid between a supply pipe and a service pipe, a check valve in the body passage, and a relief valve assembly connected to the body passage downstream of the check valve, the assembly comprising a liquid drainage passage connected to a first port in the body passage, a first valve in the drainage passage, a gas intake passage connected to a second port above the first port in the body passage, and a second valve in the intake passage.

17 Claims, 2 Drawing Figures

BACKFLOW PREVENTER

FIELD OF THE INVENTION

This invention relates to relief valves for backflow preventers.

BACKGROUND OF THE INVENTION

Backflow preventers are used, for example, in water distribution lines to stop flow of possibly contaminated water back towards the potable water supply.

Conventionally, a backflow preventer has a unidirectional check valve and, downstream of the check valve, a relief valve. The check valve opens to permit flow through the line in the normal direction only, and closes to prevent backflow through the line, should the direction of flow reverse. The relief valve, closed when flow is normal, opens during a backflow condition to drain the possibly contaminated water from the line downstream of the check valve. This drainage through the relief valve is particularly important when the check valve malfunctions, for example, by failing to close completely because fouled by debris, because it helps to prevent water from flowing past the partially open check valve.

Backflow preventers, such as those shown in Braukmann, U.S. Pat. No. 3,818,929, and Griswald, U.S. Pat. No. 3,173,439, have relief valves which discharge through a single drainage passage.

SUMMARY OF THE INVENTION

I have discovered that greater discharge can be obtained through a backflow preventer relief valve by providing a separate valved gas intake passage above the drainage passage.

In preferred embodiments of the invention the drainage and intake passages enter the body of the backflow preventer through ports respectively positioned below and above the check valve seat; one side of the check valve communicates with the valve in the intake passage by means of a tube external the backflow preventer body and a chamber bounded on one side by a diaphragm above the intake valve; the intake valve and the valve in the drainage passage are connected by a piston which seals against a wall of the relief valve assembly to prevent communication between the intake and drainage passages; the intake valve is an end contact valve and the drainage valve is a piston valve to permit precise calibration; and a removable spring assembly biases the intake and drainage valves.

In addition to its increased discharge, the relief valve of my backflow preventer is simple to construct and service.

PREFERRED EMBODIMENT

I turn now to the structure and operation of a preferred embodiment, first briefly describing the drawings thereof.

DRAWINGS

STRUCTURE

Figure 1:
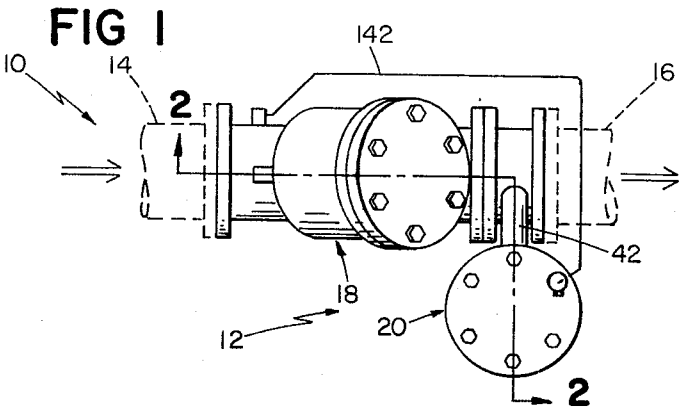
FIG. 1 is a partially schematic plan view of a backflow preventer embodying the invention.

There is shown schematically in FIG. 1 a waterline 10 having a backflow preventer 12 connected between a supply pipe 14 and a service pipe 16. Flow through the line is normally from left to right as indicated by the arrows. The backflow preventer has a check valve 18 and, downstream of the check valve, a relief valve assembly 20.

Figure 2:
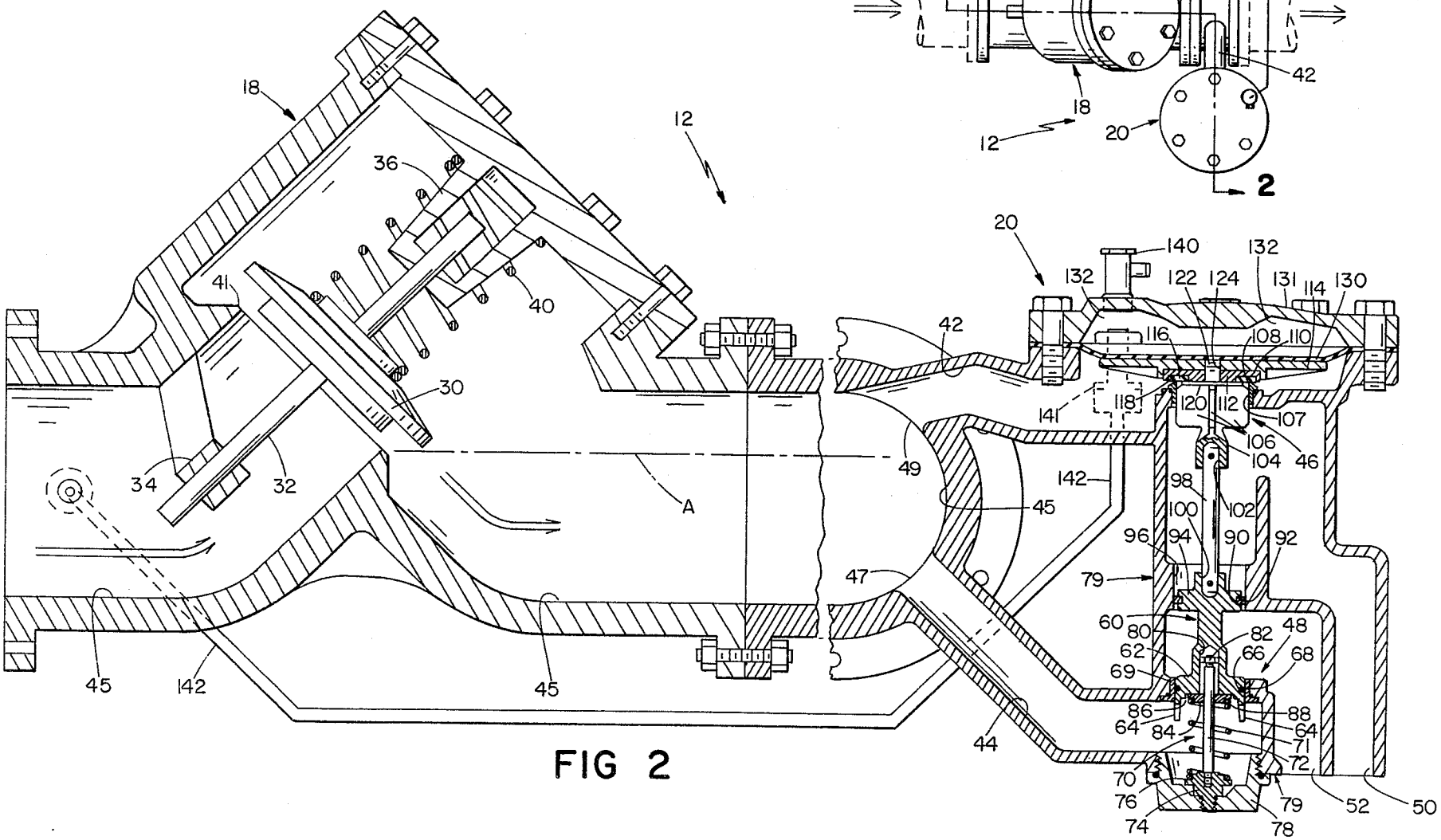
FIG. 2 is a view taken along 2—2 of FIG. 1.

Turning to FIG. 2, conventional check valve 18 is shown somewhat schematically. It has a disc 30 mounted on a stem 32. The stem is mounted to slide in guide 34 and retainer 36. Spring 40 biases the disc against seat 41.

Relief valve assembly 20 communicates with the downstream side of check valve 18 through upper passage 42, lower passage 44, and body passage 45. Passages 42 and 44 are respectively connected through valves 46 and 48 to ports 50 and 52 exposed to the atmosphere. Lower passage 44 enters body passage 45 through port 47, below horizontal plane A, which includes the lowermost point of check valve seat 41. Upper passage 42 enters body passage 45 through port 49 above port 47, and, desirably, as in the most preferred embodiment, above plane A near the top of passage 45.

Turning to valve 48, piston 60 has an enlarged shoulder 62 with four downwardly extending fingers 64. O-ring 68 in groove 66 seals piston 60 against stainless steel sleeve 69 when the valve is closed, and is above sleeve 69 when the valve is open. The uppermost end of sleeve 69 should be below plane A.

Spring assembly 70 biases piston 60 upwardly. Coil spring 71 surrounds stem 72. Guide 74 is secured to the lower end of stem 72 and provides a shoulder 76 to receive one end of spring 71. The guide is threaded in plug 78 in turn threaded in valve body 79. The upper end of stem 72 extends into counterbore 80 of piston 60, and carries a nut 82. Button 84, free to slide along stem 72, fits in counterbore 86 within fingers 64, and receives the upper end of spring 71 on shoulder 88.

Gasket 90 in groove 92 of shoulder 94 at the upper end of piston 60 seals against cylindrical wall 96 in valve body 79. The height of wall 96 is sufficient to ensure that gasket 90 remains sealed against it throughout travel of piston 60, so that passage 42 and port 50 are always out of communication with passage 44 and port 52.

Stem 98 is pinned at one end in counterbore 100 in the upper end of piston 60, and at its other end in counterbore 102 in the bottom of guide 104 of valve 46, thus connecting valves 46 and 48.

Turning in detail to valve 46, the upper portion of guide 104 has four fins 106 arranged in a cross. The fins are mounted to slide within stainless steel annular member 107, the sharp upper end of which provides valve seat 108. Disc 110 is mounted in recess 112 at the bottom of retainer 114. Rubber ring 116 is in turn mounted in recess 118 near the outer periphery of disc 110, positioned to engage seat 108 to seal between passage 42 and port 50. At its upper end guide 104 has an integral disc portion 120 and a threaded portion 122 which is screwed into hole 124, clamping retainer 114, disc 110, and ring 116 together.

Above valve 46, diaphragm 130 is clamped about its periphery between valve body 79 and cover 131, defining a chamber 132 between the cover and the upper surface of the diaphragm. A pet cock 140 is mounted in cover 131 to enable air to be bled from chamber 132. Tube 142, running between valve passage 45 and adapter 141, provides communication between the upstream side of check valve 18 and chamber 132.

OPERATION

Flow is normally from supply pipe 14, through open check valve 18 in backflow preventer 12, to service pipe 16. Relief valves 46 and 48 are closed. The pressure upstream of open check valve 18, communicated by tube 142 to the top side diaphragm 130, is greater than the pressure downstream of the check valve, communicated by passage 42 to the underside of diaphragm 130. The differential pressure across diaphragm 130 forces it downwardly against retainer 114 of valve 46, overcoming the upward biasing force of spring 71 acting against piston 60 of valve 48. The connected valves 46 and 48 move downwardly and respectively close against seat 108 and sleeve 69.

During a backflow condition check valve 18 closes; because the pressure downstream of the check valve is now greater than the pressure upstream of the check valve, the pressure differential across diaphragm 130 is reversed. The diaphragm is forced upwardly, removing the downward force acting against spring 71. The spring lifts ring 116 of valve 46 off seat 108, breaking the seal between upper passage 42 and port 50 allowing passage 42 to vent to atmosphere. Because seat 108 is sharp and faces in the direction along which valve 46 opens, thus providing end contact with ring 116, the opening is instantaneous and can be precisely calibrated to occur at a desired pressure differential across the check valve. After valve 46 opens, O-ring 68 is withdrawn from sleeve 69, opening valve 48 to allow lower passage 44 to vent to atmosphere through port 52. Water is discharged through valve 48 and, at least at first, valve 46.

When the water level in body passage 45 drops below the entrance of upper passage 42, air will be inspirated through upper passage 42 above the draining water, which continues to discharge through lower passage 44. The separate air intake passage provides more rapid drainage than a single passage relief valve system in which air intake and water discharge must take place concurrently through the same passage.

During a back siphonage condition, pressure in supply pipe 14 drops below atmospheric. Backflow from service pipe 16 closes check valve 18, and valves 46 and 48 open as described above. Should debris foul check valve 18 and prevent it from closing completely, suction in supply line 14 would draw some of the backflow through the partially open check valve, despite drainage through the relief valve assembly. Advantageously, air intake through upper passage 42 relieves the suction in supply pipe 14, increasing the rate of discharge through lower passage 44, and reducing flow past the fouled check valve.

OTHER EMBODIMENTS

Other embodiments are within the following claims, for example, two independently operable valves, one in the upper passage, and one in the lower passage, could be used in place of a connected valve arrangement. The lower valve would, by itself, open in response to a threshold pressure differential across the check valve. The upper valve might be arranged to open only in response to sub-atmospheric pressure downstream of the check valve, to allow air intake through the upper passage.

What is claimed is:

1. A backflow preventer comprising
- a body defining a passage for flow of liquid between a supply pipe and a service pipe,
- a check valve in said body passage, and
- a relief valve assembly connected to said body passage downstream of said check valve, said assembly comprising
- a liquid drainage passage connected to a first port in said body passage downstream of said check valve,
- a first valve in said drainage passage,
- a gas intake passage connected to a second port above said first port in said body passage downstream of said check valve,
- a second valve in said intake passage, and means for automatically opening said first and second valves in response to predetermined relative pressure conditions in said supply and service pipes.

2. The backflow preventer of claim 1, wherein said first port is below a horizontal plane which includes the lowermost point of the seat of said check valve.

3. The backflow preventer of claim 2, wherein said second port is above said plane.

4. The backflow preventer of claim 1, further comprising means external to said body for communicating pressure from one side of said check valve to one side of said second valve.

5. The backflow preventer of claim 4, wherein said one side of said second valve is the side facing in the direction of motion of said valve in opening.

6. The backflow preventer of claim 4, wherein the other side of said check valve and the other side of said second valve are in communication with each other through said intake passage.

7. The backflow preventer of claim 4, wherein said one side of said check valve is its upstream side.

8. The backflow preventer of claim 6, wherein said means for communicating pressure comprises
- a tube, and
- a diaphragm above said second valve,
  - said diaphragm being clamped about its periphery to define a boundary of a chamber,
  - said chamber being in communication with said one side of said check valve through said tube,
  - said diaphragm being positioned to engage said second valve, and being in communication with said other side of said check valve through said intake passage.

9. The backflow preventer of claim 4, further comprising means for connecting said first and second valves.

10. The backflow preventer of claim 9, wherein said second valve comprises
- an annular member mounted in said intake passage and having a seat at one end thereof facing in the direction along which said second valve opens, and
- a disc positioned to engage said seat to seal said intake passage.

11. The backflow preventer of claim 10, wherein said first valve comprises
- a sleeve mounted in said drainage passage,
- a piston mounted to slide in said sleeve and having a shoulder at one end thereof, and
- an O-ring in a groove of said shoulder,
  - said O-ring sealing against said sleeve to close said valve.

12. The backflow preventer of claim 10 or 11 wherein said seat is sharp.

13. The backflow preventer of claim 9, wherein said connecting means comprises a piston, said piston having a sealing means adapted to prevent communication between said drainage passage and said intake passage.

14. The backflow preventer of claim 13, wherein said piston is cylindrical, and said sealing means comprises a shoulder at the upper end of said piston, a gasket in a circumferential groove of said shoulder, and a cylindrical wall in said relief valve assembly, said gasket sealing against said wall.

15. A backflow preventer of claim 9, further comprising a spring assembly acting against said first valve, and, through said connecting means, said second valve, to bias said first and second valves in the direction along which they open.

16. The backflow preventer of claim 15, wherein said spring assembly is threadedly connected to the bottom of said relief valve assembly and is adapted to be removed therefrom.

17. The backflow preventer of claim 10, wherein said second valve further comprises a retainer having a recess in its bottom adapted to receive said disc, and a guide threadedly connected to the bottom of said retainer, said guide comprising fins mounted to slide in said annular member, an integral disc portion above said fins, and a threaded portion above said disc portion, said disc portion of said guide clamping said disc to said retainer when said guide is threaded thereto.

* * * * *